US007669847B2

(12) United States Patent
Yamaguchi

(10) Patent No.: US 7,669,847 B2
(45) Date of Patent: Mar. 2, 2010

(54) POST-PROCESSING APPARATUS AND IMAGE FORMING APPARATUS

(75) Inventor: Kouzou Yamaguchi, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/262,279

(22) Filed: Oct. 31, 2008

(65) Prior Publication Data

US 2009/0184459 A1 Jul. 23, 2009

(30) Foreign Application Priority Data

Jan. 17, 2008 (JP) ..... 2008-008029

(51) Int. Cl.
*B65H 31/26* (2006.01)

(52) U.S. Cl. ..... 271/220; 271/221; 270/58.17; 270/58.27

(58) Field of Classification Search ..... 271/220, 271/221; 270/58.17, 58.27; 414/789.1
See application file for complete search history.

(56) References Cited

U.S. PATENT DOCUMENTS

| | | | | |
|---|---|---|---|---|
| 4,147,342 | A * | 4/1979 | Naramore | 271/221 |
| 5,188,353 | A * | 2/1993 | Parks | 271/184 |
| 5,374,051 | A * | 12/1994 | Ulrich et al. | 271/222 |
| 5,639,078 | A * | 6/1997 | Mandel et al. | 270/58.12 |
| 5,857,670 | A * | 1/1999 | Jung | 270/58.12 |
| 6,698,744 | B2 * | 3/2004 | Yamada et al. | 270/58.12 |
| 6,871,851 | B2 * | 3/2005 | Tamura et al. | 271/221 |
| 7,331,573 | B2 * | 2/2008 | Mizuta et al. | 270/58.14 |
| 2002/0060414 | A1 * | 5/2002 | Yamada et al. | 271/221 |
| 2002/0163120 | A1 * | 11/2002 | Yamada et al. | 271/221 |
| 2005/0189706 | A1 * | 9/2005 | Tamura et al. | 271/221 |
| 2006/0202403 | A1 | 9/2006 | Nagata et al. | |
| 2007/0057443 | A1 * | 3/2007 | Terao et al. | 271/221 |
| 2007/0108690 | A1 * | 5/2007 | Hayashi et al. | 270/58.27 |
| 2007/0200288 | A1 * | 8/2007 | Yoshiuchi | 271/221 |
| 2008/0054552 | A1 * | 3/2008 | Saito et al. | 271/221 |

FOREIGN PATENT DOCUMENTS

| | | |
|---|---|---|
| JP | 08-026573 | 1/1996 |
| JP | 08-282901 | 10/1996 |
| JP | 2006-248685 | 9/2006 |

* cited by examiner

*Primary Examiner*—David H Bollinger
(74) *Attorney, Agent, or Firm*—Renner, Otto, Boisselle & Sklar, LLP

(57) ABSTRACT

There provided is a post-processing apparatus which has a simple structure and makes more than one sheet of recording paper easily slide down a slope of a post-processing tray, has no irregularity in the alignment of the sheets of recording paper in the discharging direction, and makes the alignment of sheets of recording paper easier after that. A finisher unit is provided with conveyance rollers for discharging sheets to a processing tray, aligning plates for guiding both sides of the sheets discharged by the conveyance rollers, and a control CPU for controlling an operation of the aligning plates. When the sheets guided by the pair of aligning plates slide down a slope of the processing tray, the control CPU causes the pair of aligning plates to vibrate in the cross direction of the sheet and in the same direction.

7 Claims, 10 Drawing Sheets

POST-PROCESSING APPARATUS AND IMAGE FORMING APPARATUS

CROSS-NOTING PARAGRAPH

This Nonprovisional application claims priority under 35 U.S.C. §119(a) on Patent Application No. 2008-008029 filed in JAPAN on Jan. 17, 2008, the entire contents of which are hereby incorporated herein by references.

FIELD OF THE INVENTION

The present invention relates to a post-processing apparatus and an image forming apparatus, more specifically, to a post-processing apparatus for performing post-processing such as binding processing and punching processing on recording paper discharged from an image forming apparatus and an image forming apparatus provided with the post-processing apparatus.

BACKGROUND OF THE INVENTION

Conventionally, an image forming apparatus such as a copier performs post-processing such as stapling on a plurality pages of recording paper subjected to printing and thereafter successively discharges the recording paper to a discharge tray. For example, like a post-processing apparatus described in Japanese Laid-Open Patent Publication No. 2006-248685, in order to improve alignment of recording paper in a processing tray for performing post-processing (hereinafter, referred to as a post-processing tray), a front end side (a downstream side in a recording paper discharging direction) of the post-processing tray is generally inclined upward. Thereby, sheets of recording paper to be discharged and fallen to the post-processing tray slide the slope of the post-processing tray and run up against a rear end side of the post-processing tray so that their rear ends are aligned.

That is, in the conventional post-processing apparatus, the recording paper is discharged to the post-processing tray and slides down the slope of the post-processing tray, and then both sides of the sheets of recording paper are pressed with aligning plates to arrange them.

However, since the alignment in a discharging direction depends on free slide down of the recording paper, the alignment is unstable, and due to friction between sheets of recording paper and friction between a sheet of recording paper and a surface of the post-processing tray, the sheet of recording paper does not slide down the slope of the discharge tray and therefore sometimes stops in the middle of the slope. When a sheet of the recording paper does not slide down the slope of the post-processing tray to the end, the front end part of the sheet sticks out in the discharging direction of the recording paper, and this makes it difficult to align sheets of recording paper. In particular, in the case of a stapling mode, all sheets of recording paper can not be held together with staples and there is a risk of missing some of them.

As described above, when the post processing is carried out in a state where sheets of recording paper are not aligned in the post-processing tray, sheets of recording paper after the post processing are in the discharge state as shown in FIGS. 10A through 10C, and a user needs to align the sheets of recording paper again.

With respect to this matter, Japanese Laid-Open Patent Publication No. 8-282901 describes a technique to prevent sheets of recording paper from stopping in the middle of the slope of the bin by vibrating a bin group up and down when a first sheet of recording paper is discharged to a bin.

However, an object of the technique described in the Japanese Laid-Open Patent Publication No. 8-282901 is to improve irregularity in alignment caused by friction between the sheet of recording paper discharged to each bin first and a surface of each bin, but not to improve irregularity in alignment caused by friction between sheets of recording paper. Accordingly, since the second and subsequent sheets of recording paper can not smoothly slide down the slope of the discharge tray, the sheets may not aligned in the discharging direction.

Moreover, in the technique described in the Japanese Laid-Open Patent Publication No. 8-282901, since the bin is vibrated up and down by changing the direction of rotation of a bin lift motor instantaneously, the control is complicated, and further since the bin itself is vibrated up and down instantaneously, loads on the apparatus is also large.

SUMMARY OF THE INVENTION

An object of the present invention is to provide a post-processing apparatus which has a simple structure and makes more than one sheet of recording paper easily slide down a slope of a post-processing tray, has no irregularity in the alignment of the sheets of recording paper in the discharging direction, and makes the alignment of sheets of recording paper easier after that, and an image forming apparatus provided with the post-processing apparatus.

Another object of the present invention is to provide the post-processing apparatus comprising: a discharging portion for discharging sheets of recording paper to a post-processing tray; recording paper guide portions for guiding both sides of the recording paper discharged by the discharging portion; and a control portion for controlling the operation of the recording paper guide portions, wherein when the recording paper guided by the recording paper guide portions slides down the slope of the post-processing tray, the control portion causes the recording paper guiding portions to vibrate in the direction of the width of the recording paper.

Another object of the present invention is to provide the post-processing apparatus, wherein a pair of the recording paper guiding portions is included, and the control portion causes the pair of the recording paper guiding portions to vibrate in the same direction.

Another object of the present invention is to provide the post-processing apparatus, wherein a pair of the recording paper guiding portions is included, and the control portion causes the pair of the recording paper guiding portions to vibrate in a different direction to each other.

Another object of the present invention is to provide the post-processing apparatus, wherein when the recording paper discharged to the post-processing tray came in contact with the lower end of the post-processing tray, the recording paper guiding portions, in accordance with the control of the control portion, sandwich side ends of the recording paper to perform aligning processing.

Another object of the present invention is to provide the post-processing apparatus, wherein the recording paper guiding portions, in accordance with the control of the control portion, arrange the recording paper discharged to the post-processing tray in a predetermined reference position.

Another object of the present invention is to provide the post-processing apparatus, wherein the recording paper guiding portions are aligning plates provided in a stapling unit.

Another object of the present invention is to provide an image forming apparatus provided with the post-processing apparatus.

PREFERRED EMBODIMENTS OF THE INVENTION

Figure 1:
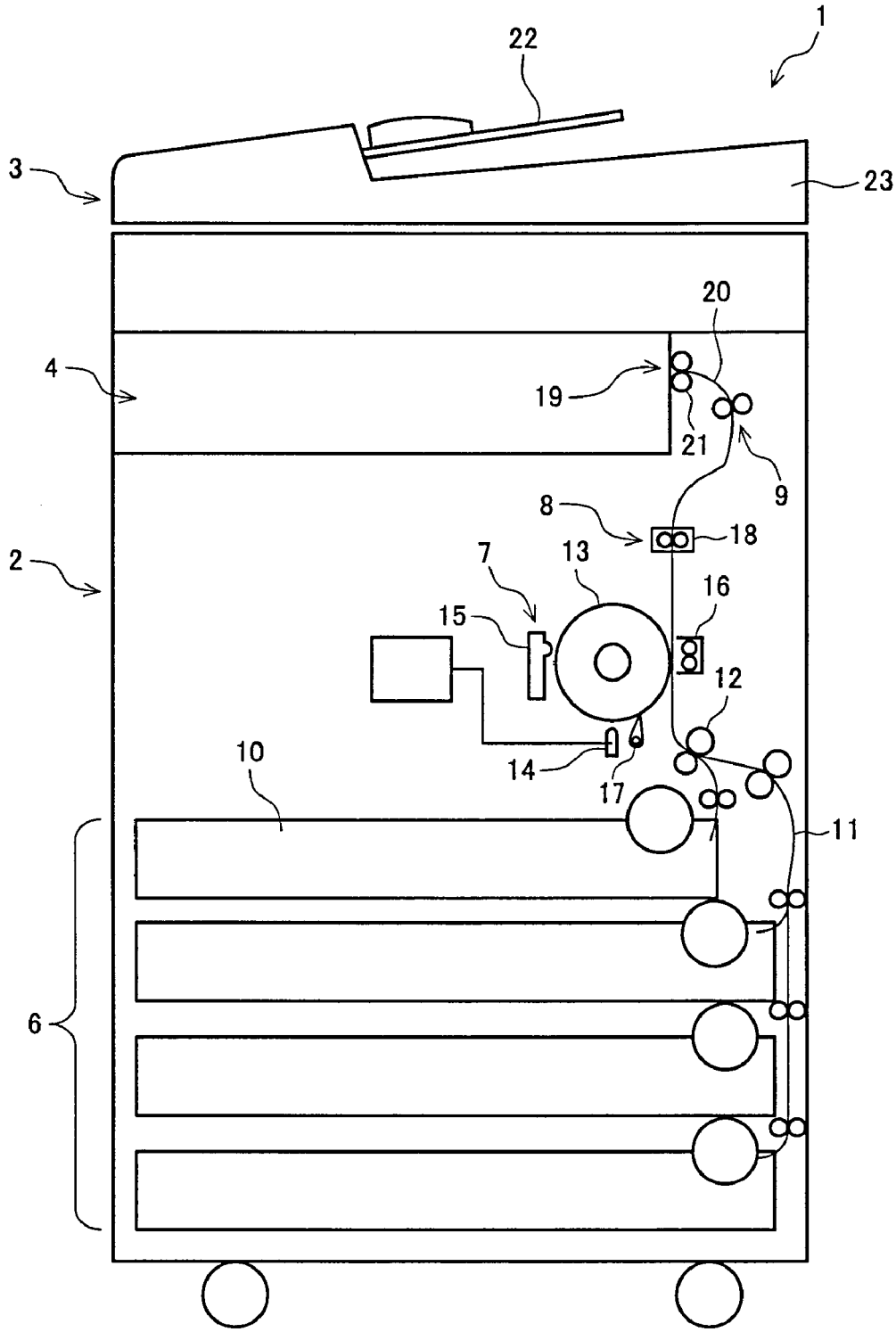
FIG. 1 is a view showing a schematic structural example of an image forming apparatus to which a post-processing apparatus according to an embodiment of the present invention is applied.

FIG. 1 is a view showing a schematic structural example of an image forming apparatus to which a post-processing apparatus according to an embodiment of the present invention is applied. In the figure, an image forming apparatus 1 is composed of an image forming unit 2 that performs feeding processing of recording paper (hereinafter, referred to as an appropriate sheet), printing processing (image formation processing), fixing processing, and the like, an image reading unit 3 that performs reading processing of an original image, and a finisher unit 4 corresponding to a post-processing apparatus of the present invention that performs post-processing such as binding processing, punching processing, and the like on the sheets discharged from the image forming unit 2. The structure of each unit will be described below.

The image forming unit 2 is composed of a feeding portion 6, a printing portion 7, a fixing portion 8, and a discharging portion 9, which are incorporated into an exterior casing. The feeding portion 6 is composed of paper feed cassettes 10 that store sheets, and feeding rollers (not shown) that successively separate and feed the sheets in the paper feed cassettes 10 one by one. In FIG. 1, a plurality of paper feed cassettes 10 are provided, which shows that the sheets stored in each of the paper feed cassettes 10 can be fed selectively. A sheet fed from the paper feed cassette 10 is transported through a feeding path 11 formed toward an upper part of the exterior casing. A resist roller 12 is disposed in a destination of the sheet transported through the feeding path 11. The printing portion 7 is provided in a conveyance destination of the sheet by the resist roller 12.

Although the printing portion 7 can be composed of various kinds of printing mechanisms such as electrostatic printing, ink jet printing, silk screen printing, and the like, FIG. 1 shows an electrostatic printing mechanism. The printing portion 7 is composed of an electrostatic drum 13, a printing head 14, a developing device 15, a transfer charger 16, and a cleaning head 17. For example, original image data read from the image reading unit 3 is sent to the printing head 14 successively. The printing head 14 irradiates light such as laser light to the electrostatic drum 13 depending on the original image data to form a latent image. The developing device 15 causes toner to adhere to the latent image formed on the electrostatic drum 13 and the transfer charger 16 transfers the toner on the electrostatic drum 13 to the transported sheet so that an image is formed on the sheet. Note that, the timing when a front end of the sheet is sent to a transfer region is controlled by the resist roller 12. The cleaning head 17 removes the toner remaining on the electrostatic drum 13 after transfer.

The fixing portion 8 is provided in a destination where a sheet is sent from the printing portion 7. The fixing portion 8 includes a pair of fixing rollers 18, and the fixing rollers 18 heat and fix the image formed on the sheet. The fixing rollers 18 apply heat at a temperature, for example, from 150 to 200 degrees C. to the image on the sheet to solidify the toner. The sheet subjected to fixing processing in the fixing portion 8 is sent to the discharging portion 9. The discharging portion 9 is composed of a discharge path 20 that guides the sheet to a discharge outlet 19 formed toward the finisher unit 4, and a pair of discharging rollers 21 provided on the discharge path 20. The sheet sent to the discharging portion 9 is transported through the discharge path 20 and discharged from the discharge outlet 19 to the finisher unit 4 by the discharging rollers 21.

The image reading unit 3 is disposed above the image forming unit 2, and is well known as a so-called scanner that reads an original image. The image reading unit 3 has a casing 23 formed with an original table 22 on an upper face thereof. A platen made of glass and the like is provided inside the casing 23, and an optical mechanism such as a light source lamp, an image-forming lens, and the like and a photoelectric conversion element are provided under the platen. On the other hand, above the platen, a feeder is provided to transport an original on the original table 22 to the platen successively. The light source lamp irradiates light to the original transported onto the platen by the feeder, the reflected light is collected by the image-forming optical mechanism such as a mirror, a lens and the like to the photoelectric conversion element such as a line sensor and the like to form an image, and thereby the original image is electrically read.

Figure 2:
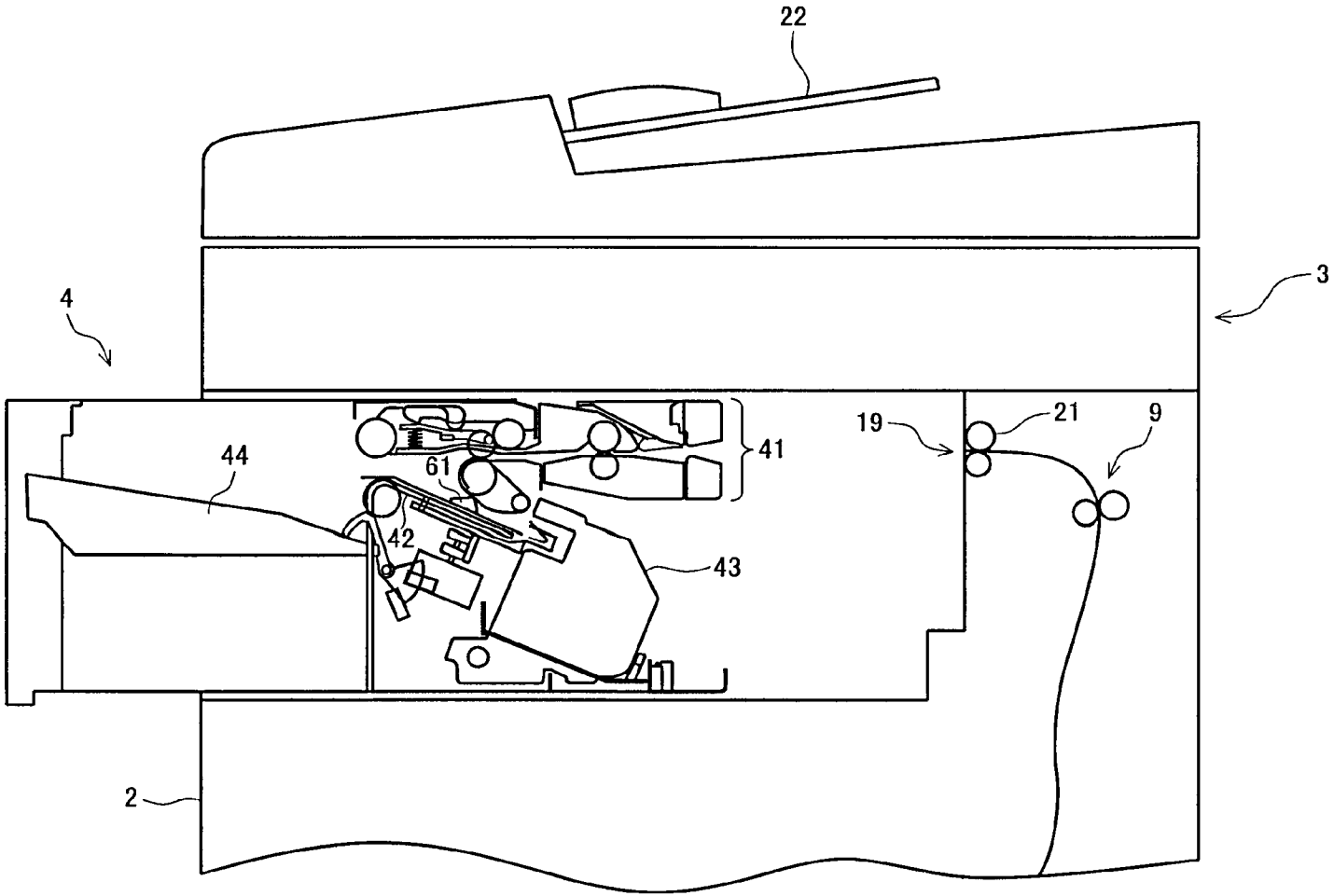
FIG. 2 is a view showing an example of a state where a finisher unit is pulled out from an image forming unit.

The finisher unit 4 is disposed between the image forming unit 2 and the image reading unit 3, and as shown in FIG. 2, is incorporated so as to be drawable from the image forming unit 2. The figure shows a state where the finisher unit 4 is pulled out from the image forming unit 2. As shown in FIG. 2, the finisher unit 4 includes a sheet conveyance portion 41 in which a conveyance path for transporting the sheet sent from the image forming unit 2 is formed, a processing tray 42 corresponding to a post-processing tray on which the sheet transported by the sheet conveyance portion 41 is placed temporarily, an aligning plate 61 corresponding to a recording paper guide portion for guiding side ends of the sheet on the processing tray 42, a post-processing portion 43 that applies post-processing such as binding processing, punching processing, and the like on the sheets placed on the processing tray 42, and a collection tray 44 to which the sheet (a bundle of sheets) subjected to the post-processing is discharged. In a state where the finisher unit 4 is pushed into the image forming unit 2, the conveyance path formed in the sheet conveyance portion 41 is composed so as to be coupled with the discharge outlet 19 of the image forming unit 2.

Figure 3:
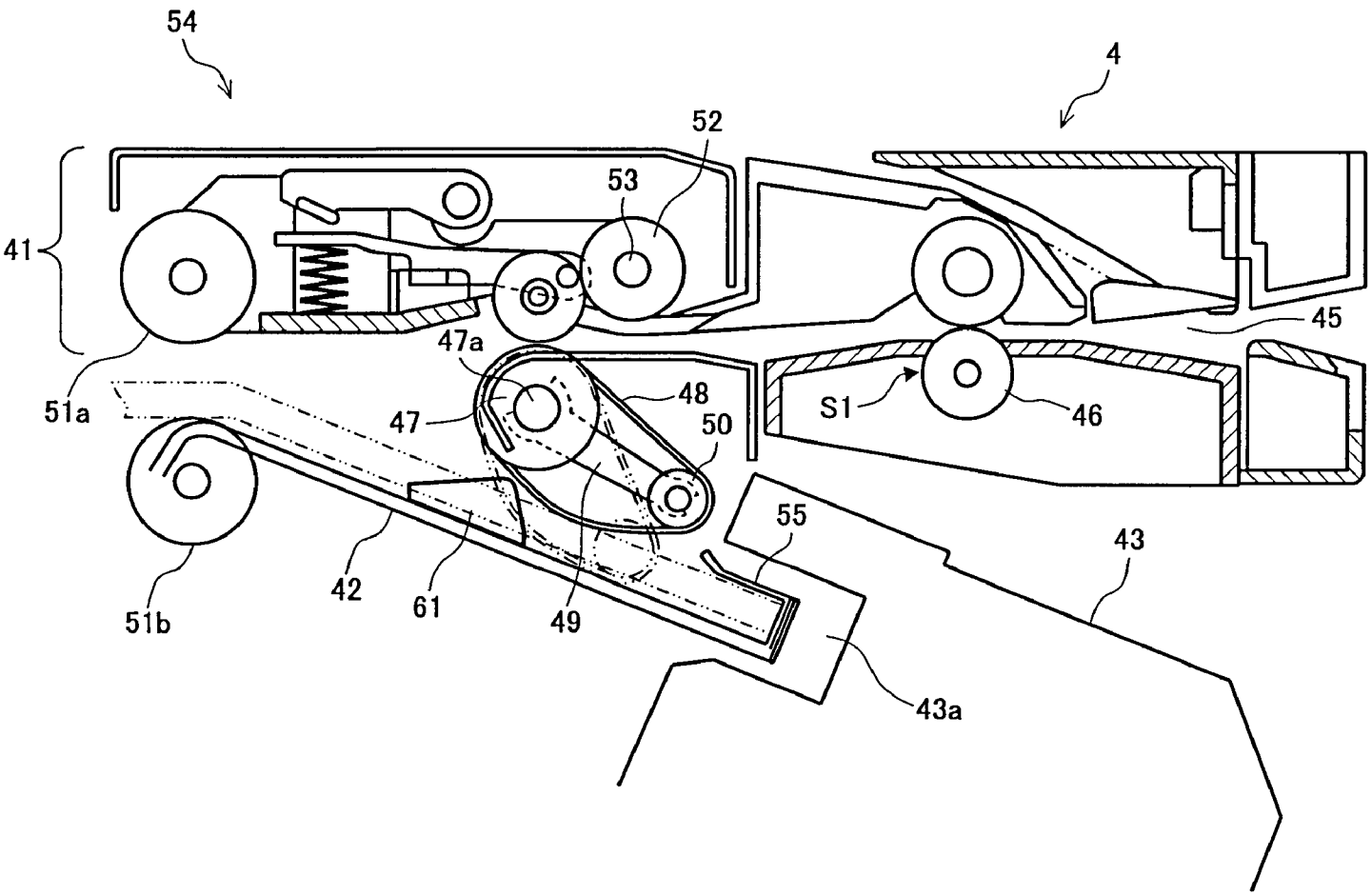
FIG. 3 is a view illustrating an example of a positional relation among a sheet conveyance portion, a processing tray, and a post-processing portion of the finisher unit.

FIG. 3 is a view illustrating an example of a positional relation among the sheet conveyance portion 41, the processing tray 42, and the post-processing portion 43 of the finisher unit 4.

As shown in FIG. 3, a conveyance path 45 that transports a sheet sent from the image forming unit 2 in a horizontal direction is formed in the sheet conveyance portion 41. On the conveyance path 45, conveyance rollers 46 and 47 are attached so as to expose part of the rollers onto the conveyance path 45. An entrance sensor S1 for detecting a front end and a rear end of a transported sheet is provided in a portion slightly closer to the sheet conveyance direction than the conveyance rollers 46.

The conveyance roller 47 is attached in the vicinity of a termination part of the conveyance path 45, and discharges the sheet to the processing tray 42. A caterpillar belt 48 that moves a sheet to a positioning means, which will be described later, and sends the sheet on the processing tray 42 to the collection tray 44 side is attached to the conveyance roller 47. The caterpillar belt 48 has another end that is attached to a pulley 50 attached to a support arm 49 which is disposed to a roller shaft 47*a* of the conveyance roller 47 so as to be able to swing around the shaft. The caterpillar belt 48 is supported to swing around the roller shaft 47*a*, the caterpillar belt 48 contacts with a sheet placed on the processing tray 42 and is driven to rotate by the roller shaft 47*a*.

Discharging rollers 51 are attached at positions separated by predetermined distance from the conveyance roller 47. The discharging rollers are used to discharge the sheet placed on the processing tray 42 to the collection tray 44. An upper discharging roller 51*a* is attached to a front end part of a sheet discharging mechanism 54 which is structured so as to be able to move in up and down directions around a roller shaft 53 of a driving roller 52 provided at a position separated by a predetermined distance. When discharging the sheet on the processing tray 42 to the collection tray 44, the sheet discharging mechanism 54 lowers the discharging roller 51*a* to the position of the sheet. A transmission belt (not shown) is disposed around the discharging roller 51*a* and the driving roller 52 so as to transmit rotational driving force of the driving roller 52 to the discharging roller 51*a*.

The processing tray 42 is disposed under the sheet discharging mechanism 54. The processing tray 42 is attached with the left side shown in the figure inclined upward. The sheet discharged to the processing tray 42 moves to a lower end part on the right side shown in the figure by gravitational force and driving force of the caterpillar belt 48. More than one positioning means 55 is attached to the lower end part of the processing tray 42 along the width direction of a sheet (refer to FIG. 4 below). Each of the positioning means 55 has a substantially U-shaped cross section which is opened to the upper end side of the processing tray 42. When the positioning means 55 comes into contact with the front end of the sheet, a position of the sheet on the processing tray 42 is determined. Note that, in FIG. 3, an example of the sheets (a bundle of sheets) positioned by the positioning means 55 is indicated by the double dots-dash line.

The post-processing portion 43 is disposed in front of the lower end part of the processing tray 42. The post-processing portion 43 has a holding portion 43*a* that holds the lower end part of the processing tray 42 in the upper left side thereof, and applies post-processing at a predetermined position of the sheet on the processing tray 42. In particular, the present embodiment describes the post-processing portion that performs only binding processing as the post-processing. However, a function of the post-processing portion 43 is not limited thereto.

A main characteristic portion of the present invention is to make more than one sheet easily slide down the slope of the processing tray 42 corresponding to the processing tray using a simple structure, to have no irregularity in the alignment of the sheets in the discharging direction and to make the alignment of the sheets easier after that. In order to attain this, the finisher unit 4 corresponding to the post-processing apparatus of the present invention includes the conveyance roller 47 corresponding to a discharging portion for discharging sheets to the processing tray 42, the aligning plate 61 corresponding to the recording paper guide portion for guiding both side ends of the sheet discharged by the conveyance roller 47, and a control CPU (refer to FIG. 6 below) corresponding to a control portion for controlling an operation of the aligning plate 61.

When the sheet the side ends of which are guided by the aligning plate 61 slides down the slope of the processing tray 42, the control CPU 70 controls the aligning plate 61 to vibrate in the cross direction of the sheet. Thereby, since the sheet on the processing tray 42 reciprocates between two points separated by a minute distance in the cross direction of the sheet, the sheets slide the slope of the processing tray 42 more easily. The sheet on the processing tray 42 reciprocates between two points separated by a minute distance due to the vibration of the aligning plate 61, and thereafter a front end part of the caterpillar belt 48 comes into contact with the sheet. Then, the sheet being contact with the front end part of the caterpillar belt 48 moves to the lower end part of the processing tray 42 by the driving force of the caterpillar belt 48, and thereafter the sides of the sheets are sandwiched by the aligning plates 61 to be subjected to aligning processing, and post processing by the post-processing portion 43 is carried out. The sheet aligning processing by the aligning plates 61 will be described later with reference to FIGS. 7A to 9C.

Figure 4:
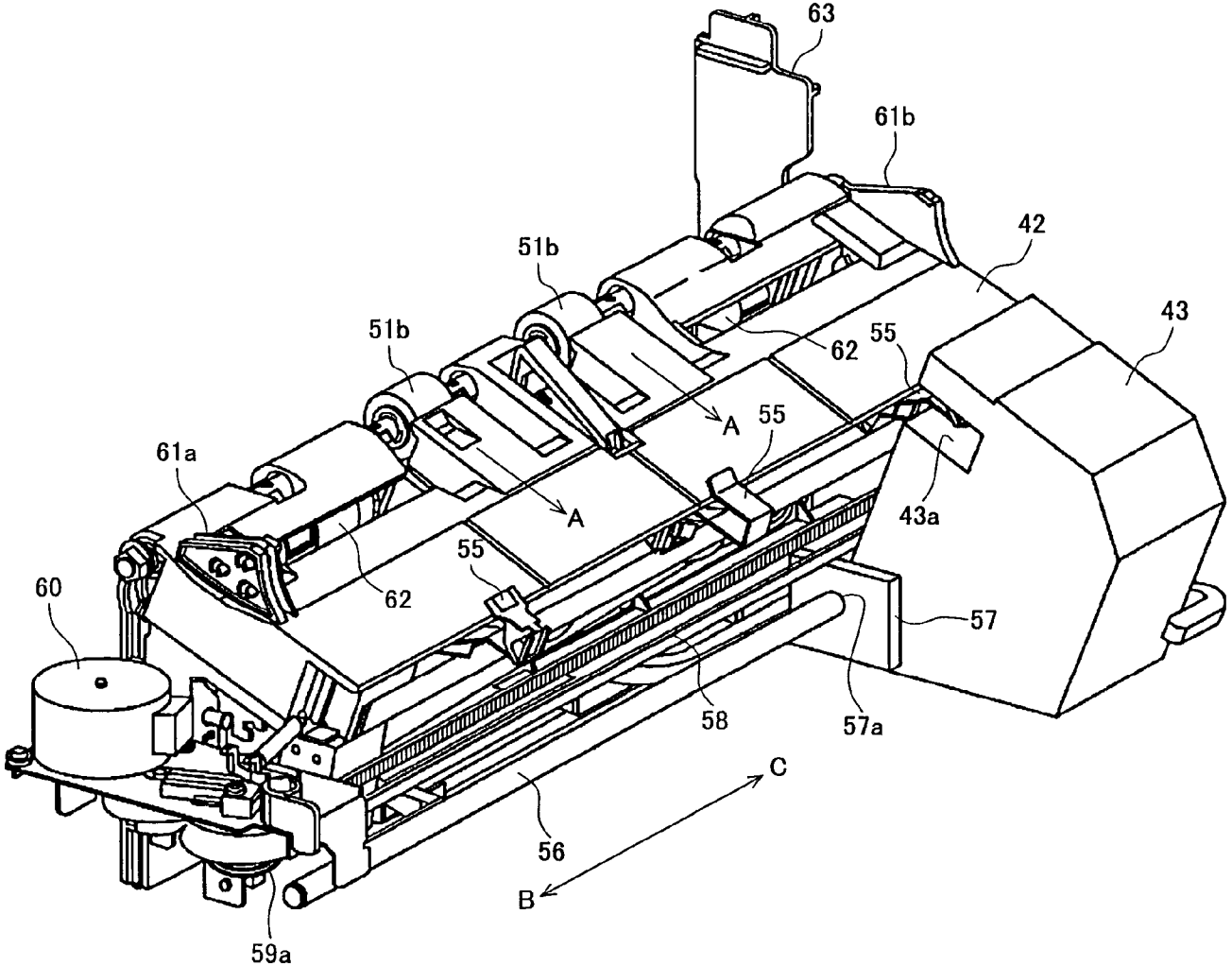
FIG. 4 is a view illustrating an example of a positional relation between the processing tray and the post-processing portion of the finisher unit.

FIG. 4 is a view illustrating an example of a positional relation between the processing tray 42 and the post-processing portion 43 of the finisher unit 4.

As shown in FIG. 4, three pieces of the positioning means 55 are attached to the lower end part of the processing tray 42 along the direction (direction indicated by the arrows B and C in the figure) perpendicular to the sheet conveyance direction indicated by the arrow A. The positioning means 55 is attached so as to protrude from the front end of the processing tray 42. The post-processing portion 43 is disposed so that parts corresponding to the positioning means 55 are held in the holding portion 43*a*. Accordingly, the holding portion 43*a* holds the front end parts of the sheets positioned by the positioning means 55.

Next, the structure of the post-processing portion 43 will be described. The post-processing portion 43 includes a stapling mechanism inside a housing thereof. The stapling mechanism is composed of a head portion and an anvil portion. The head portion bends a needle-shaped staple (hereinafter, referred to as a "staple needle") into a U-shape to strike out the staple needle so as to press-fit into the sheet on the processing tray 42. The anvil portion receives the front ends of the staple needle struck out from the head portion to bend. Thereby, the sheets on the processing tray 42 are subjected to the binding processing.

A travel shaft 56 of the post-processing portion 43 is disposed along the direction indicated by the arrows B and C in the figure under the processing tray 42. The travel shaft 56 is fixed at an end part thereof to a housing (hereinafter, referred to as a "unit frame") of the finisher unit 4, and penetrates through a fit hole 57*a* formed in a shaft holding portion 57 fixed to the side of the post-processing portion 43. Above the travel shaft 56, a timing belt 58 is attached substantially in parallel with the travel shaft 56. The timing belt 58 is laid between pulleys 59*a* and 59*b* (not shown) provided near the end part of the unit frame, and is fixed to the post-processing portion 43 at the predetermined position. The rotational driving force from a unit moving motor 60 is transmitted via a transmission gear to the pulley 59*a*. By driving the unit moving motor 60 to rotate clockwise and counter-clockwise, the post-processing portion 43 is structured so as to be movable along the direction of the arrows B and C in the figure.

Aligning plates 61*a* and 61*b* having L-shape in cross section are attached on the sheet conveyance path in the processing tray 42. A slit groove 62 is formed in the processing tray 42 in the direction perpendicular to the sheet conveyance direction, and the aligning plates 61 are attached to the slit groove 62 so as to be slidable along the direction of the arrows B and C in figure. The aligning plates 61 push a side edge part of the sheet to a side of the tray and move the sheet to the predetermined position on the processing tray 42. It is assumed in the image forming apparatus 1 according to the present embodiment that the sheet is fed from the image forming unit 2 taking the center in the cross direction of the sheet as a reference position. Therefore, sheets having images formed thereon with different width sizes are stacked on the processing tray 42 based on the center position in the cross direction of the sheet.

Moreover, the finisher unit 4 has side plates 63 fixed to a side end part of the processing tray 42. The side plates 63 are provided to prevent the sheet transported on the processing tray 42 from being transported off the processing tray 42. FIG. 4 shows only one of the side plates 63 (back side in FIG. 4), and the other side plate 63 (front side in FIG. 4) is omitted.

Figure 5:
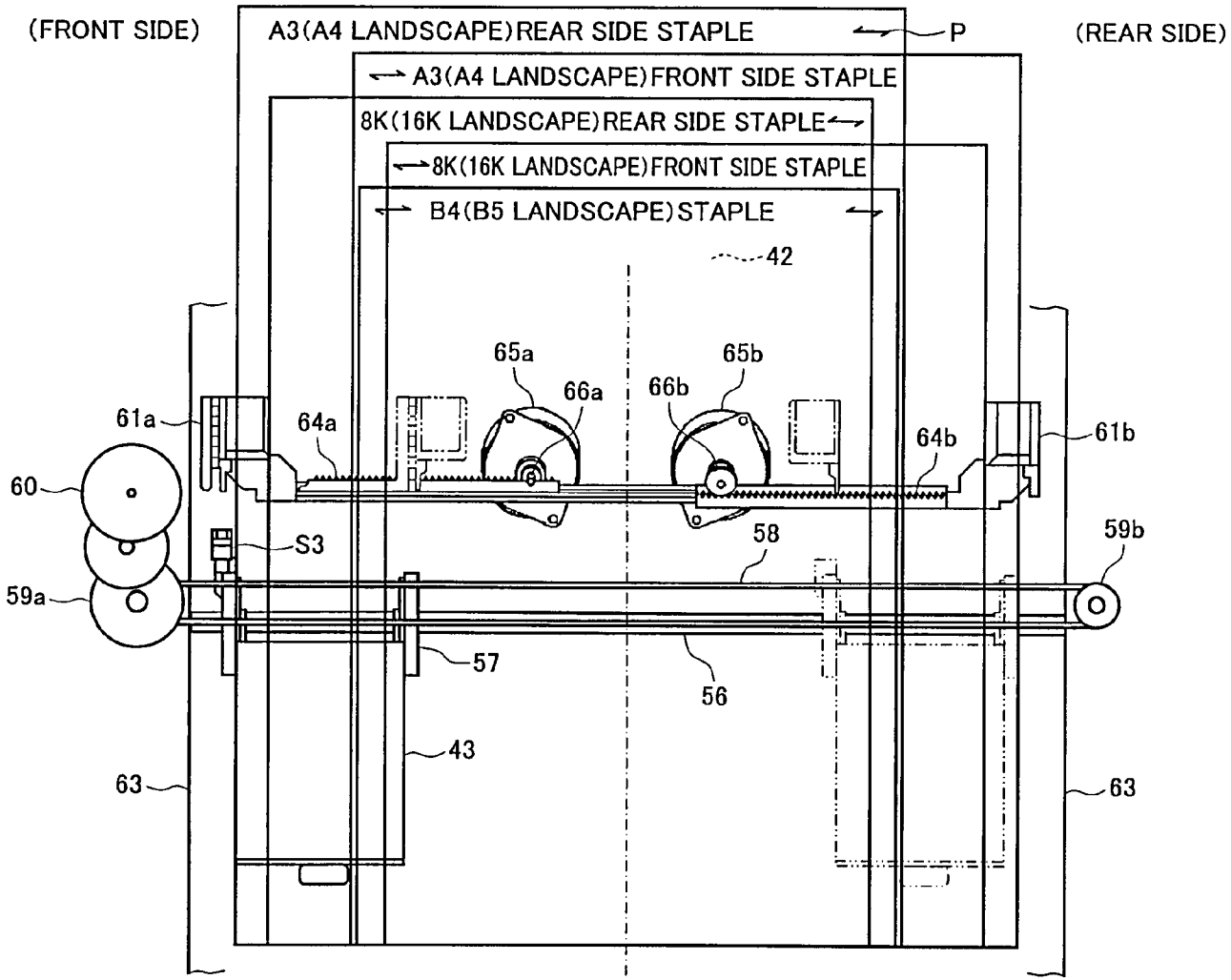
FIG. 5 is a top view of the processing tray and the post-processing portion including the internal structure of aligning plates.

FIG. 5 is a top view of the processing tray 42 and the post-processing portion 43 including the internal structure of the aligning plates 61. Note that, FIG. 5 shows a relation between sheets of various kinds of sizes targeted for the binding processing and positions on the various kinds of sheets to be subjected to the binding processing. For convenience in explanation, the positions to be subjected to the binding processing are shown in the upper side in FIG. 5.

As shown in FIG. 5, each of the aligning plates 61 is provided, with a rack 64 so as to extend a leg portion having L-shape in cross section on the rear side (inner side) of the processing tray 42. An aligning motor 65 is disposed near the rack 64. A pinion gear 66 disposed on a driving shaft of the aligning motor is engaged with the rack 64. A well-known deceleration mechanism is provided between the aligning motor 65 and the pinion gear 66.

Each of aligning motors 65*a* and 65*b* (hereinafter, the aligning motor 65*a* is referred to as a "first aligning motor 65*a*" and the aligning motor 65*b* is referred to as a "second aligning motor 65*b*" appropriately) is composed of, for example, a stepping motor, and, by receiving supply of predetermined power pulses, causes the aligning plates 61*a* and 61*b* to come close to or separate from each other by the same amount. Position sensors S2 (not shown) that detect positions of the aligning plates 61*a* and 61*b* are provided near the aligning plates 61*a* and 61*b*, and home positions are set for the aligning plates 61*a* and 61*b* at positions indicated by solid line in FIG. 5. When the power supply pulses corresponding to the sheet size notified from the image forming unit 2 are supplied to the aligning motors 65*a* and 65*b*, the aligning plates 61*a* and 61*b* move to standby positions corresponding to the sheet size, and after the sheet is transported onto the processing tray 42, vibrate (reciprocate between two points by a minute distance) in the cross direction of the sheet while the sheet slides down the slope of the processing tray 42, and when the front end of the sheet comes into contact with the lower end part of the processing tray 42, shift widths of the sheet to neatly position on a center basis. Hereinafter, the position of the sheet positioned on a center basis is referred to as a "center position".

Moreover, a position sensor S3 that detects a position of the post-processing portion 43 is provided at one end part of the shaft holding portion 57 fixed to the post-processing portion 43, and a home position is set at the solid-line position shown in FIG. 5. The position sensor S3 is composed of, for example, an actuator provided on the post-processing portion 43 side and a photosensor provided on the unit frame side. When power supply pulses corresponding to the sheet size notified from the image forming unit 2 are supplied to the unit moving motor 60, the post-processing portion 43 firstly moves to a predetermined standby position (center position in the cross direction of the sheet), and after the sheet is transported onto the processing tray 42, moves to a post-processing position corresponding to the sheet size.

When performing the binding processing at different positions of the sheet by the post-processing portion 43, in order to reduce the amount of movement of the post-processing portion 43, the finisher unit 4 according to the present invention is structured so as to move the post-processing portion 43 as well as move the sheets on the processing tray 42 substantially in parallel with the moving direction of the post-processing portion 43.

In particular, the finisher unit 4 determines whether to move only the post-processing portion 43 or move the post-processing portion 43 and the sheets depending on the size of the transported sheets. That is, the finisher unit 4 moves only the post-processing portion 43 in the case of the sheet of a size less than a predetermined size, while it moves the post-processing portion 43 and the sheets in the case of the sheets of a size not less than the said size. Specifically, the finisher unit 4 is structured so as to move only the post-processing portion 43 in the case of the sheets of a size (for example, B4 and A4) less than 8K size of sheet size in China, while it moves the post-processing portion 43 and the sheets for sheets (for example, 8K and A3) not less than 8K size.

FIG. 5 shows only B4-size, 8K-size, and A3-size sheets. Note that, it is assumed that the figure shows the sheets transported in a longitudinal direction of the sheet, unless otherwise described. Further, the left side in FIG. 5 shows a "front side", and the right side in FIG. 5 shows a "rear side". In addition, a staple needle is shown by "P".

In the finisher unit 4, when the binding processing is applied to B4-size sheets, only the post-processing portion 43 is moved, and the post-processing is applied at a predetermined position of the sheets without moving the sheets. Thus, when applying the binding processing to the front side and the rear side, the position of the B4-size sheets is the same.

Meanwhile, when the binding processing is applied to 8K-size sheets, not only the post-processing portion 43 but also the sheets are moved. That is, when applying the binding processing to the front side of 8K-size sheets, the post-processing portion 43 is moved from the standby position (center position in the cross direction of the sheet) to the front side (to the left side), while the sheets are moved from the center position to the rear side (to the right side). Meanwhile, when applying the binding processing to the rear side, the post-processing portion 43 is moved from the standby position to the rear side (to the right side), while the sheets are moved from the center position to the front side (to the left side). Thus, when the binding processing is applied to the front side and the rear side, the positions of the 8K-size sheets are different. Note that, the binding processing for A3-size sheets is similar to that for 8K-size sheets.

Figure 6:
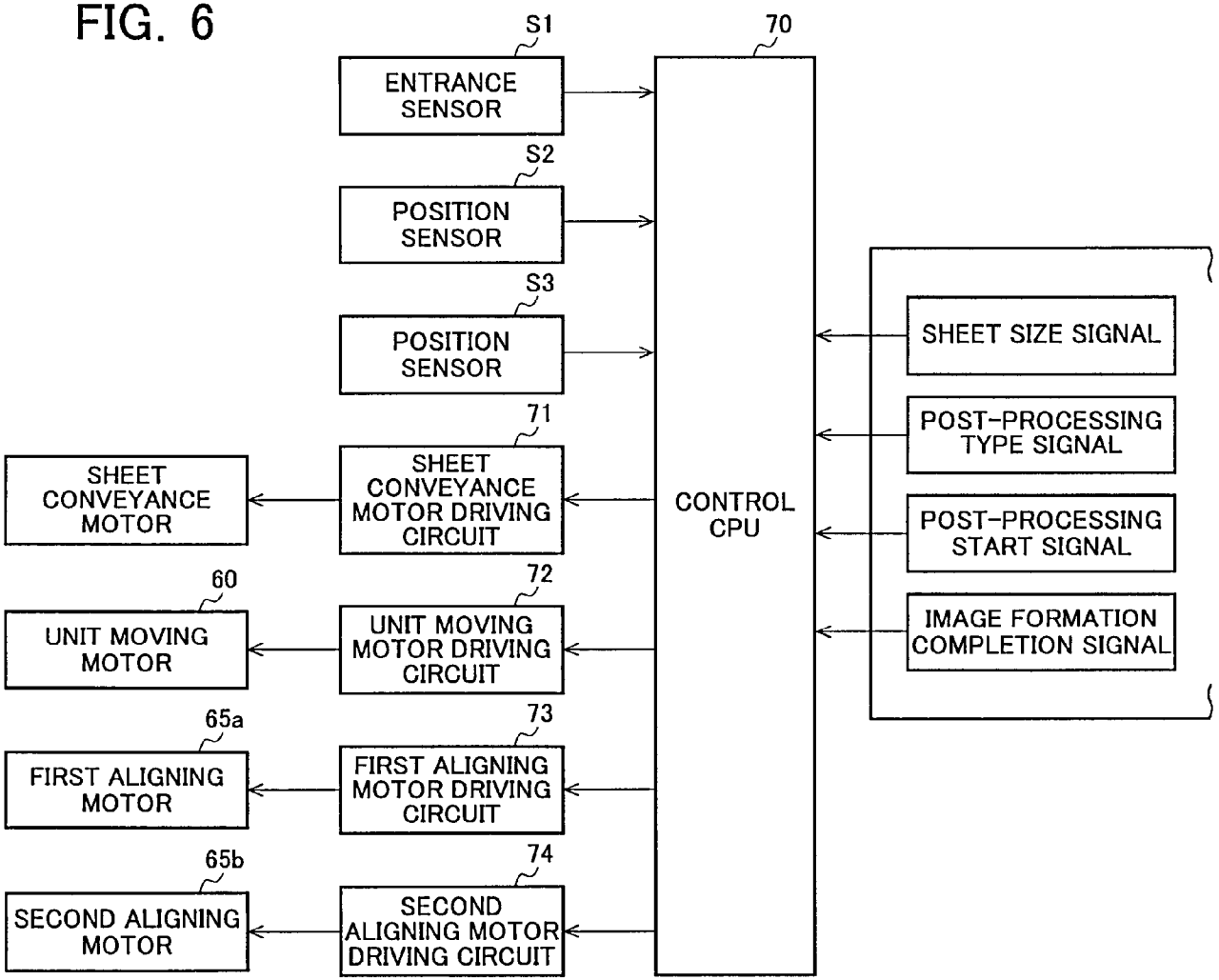
FIG. 6 is a block diagram showing an example of components associated with control of binding processing performed in the finisher unit.

Next, description will be given for structural elements associated with control of the binding processing performed in the finisher unit 4 of the present embodiment, with reference to FIG. 6. FIG. 6 is a block diagram showing an example of structural elements associated with control of the binding processing performed in the finisher unit 4.

The control CPU 70 controls the entire image forming apparatus 1 including the finisher unit 4, and when executing the control, the CPU 70 reads a control program from a ROM (not shown) and uses a RAM (not shown) as a work area. In particular, FIG. 6 shows structural elements associated with the binding processing performed by the finisher unit 4, and other structure is omitted.

Various kinds of signals necessary to execute the binding processing is input to the control CPU 70 from the image forming unit 2. Specifically, a signal showing the size of transported sheets (a sheet size signal), a signal showing the type of post-processing to be executed in the finisher unit 4 (a post-processing type signal), a signal to indicate the start of the post-processing (a post-processing start signal), and a signal showing the completion of image formation on the sheets (an image formation completion signal) are input to the control CPU 70.

Moreover, the control CPU 70 is connected to various kinds of sensors, and signals from various kinds of sensors are input to the control CPU 70. Specifically, a signal detecting a front end of a sheet (hereinafter, referred to as a "sheet front end detection signal") or a signal detecting a rear end of a sheet (hereinafter, referred to as a "sheet rear end detection signal") from the entrance sensor S1, signals of detecting positions of the aligning plates 61 from the position sensors S2, and a signal of detecting a position of the post-processing portion 43 from the position sensor S3 are input to the control CPU 70.

Further, the control CPU 70 is connected to various kinds of motor driving circuits. Specifically, a sheet conveyance motor driving circuit 71 for controlling driving of the sheet conveyance motor that applies driving force to the conveyance rollers 46 and 47 and the discharging roller 51*a*, a unit moving motor driving circuit 72 for controlling driving of the unit moving motor 60, a first aligning motor driving circuit 73 for controlling driving of the first aligning motor 65*a*, and a second aligning motor driving circuit 74 for controlling driving of the second aligning motor 65*b* are connected to the control CPU 70. The control CPU 70 outputs control signals to these motor driving circuits based on various kinds of signals received from the image forming unit 2 and various kinds of sensor signals sent from the various kinds of sensors.

Next, description will be given for operations when the finisher unit 4 performs the post-processing (the binding processing) in the image forming apparatus 1 having the above-mentioned structure, with reference to FIG. 5. Note that, description will be given to the case where A3-size sheets are transported as the sheets (A3 (A4 landscape) shown in FIG. 5) on which the binding-processing is executed. In addition, it is assumed that the binding processing by the post-processing portion 43 is performed to the front side first and then to the rear side shown in FIG. 5. Note that, the order of the binding processing will not be limited thereto.

For example, when a user of the image forming apparatus 1 places an original with a plurality of pages on the original table 22 and instruction of image formation processing (copy processing) is given, a sheet size signal of the original targeted for the processing and a post-processing type signal are input from the image forming unit 2 to the control CPU 70. Here, it is assumed that a binding processing signal is input to the control CPU 70 as the post-processing type signal and the post-processing type signal is the signal to instruct the control CPU 70 to execute the binding processing at different two end parts of sheets.

When the sheet size signal is received, the control CPU 70 drives the first aligning motor 65*a* and the second aligning motor 65*b* through the first aligning motor driving circuit 73 and the second aligning motor driving circuit 74. At this time, the control CPU 70 supplies power supply pulses corresponding to the sheet size to the first aligning motor 65*a* and the second aligning motor 65*b*. Thereby, the aligning plates 61*a* and 61*b* move to standby positions which are placed at a distance of slightly larger than the sheet width from each other (the shorter side of the A3-size sheet). Note that, before the aligning plates 61 is moved to the standby positions, the aligning plates 61 are disposed at the home positions shown by the solid-line position in FIG. 5.

When the image formation processing is completed in the printing portion 7, an image formation completion signal is input from the image forming unit 2 to the control CPU 70. When the image formation completion signal is received, the control CPU 70 drives the sheet conveyance motor through the sheet conveyance motor driving circuit 71. Thereby, the conveyance rollers 46 and 47 and the discharging roller 51*a* in the finisher unit 4 are rotated. Then, the sheet sent to the finisher unit 4 is transported on the conveyance path 45 by the conveyance rollers 46 and 47.

When the transported sheet passes through the entrance sensor S1 formed on the conveyance path 45, a sheet rear end detection signal is input from the entrance sensor S1 to the control CPU 70. When the sheet rear end detection signal is received, the control CPU 70 calculates an estimate time from the time when it receives that signal to the time when the sheet reaches the processing tray 42, and after the estimate time has elapsed, the control CPU 70 drives the first aligning motor 65*a* and second aligning motor 65*b*. At this time, the control CPU 70 supplies the power supply pulses to the first aligning motor 65*a* and the second aligning motor 65*b* so that the aligning plates 61 vibrate (that is, reciprocate between two points separated by minute distance) from the above-mentioned standby positions in the sheet width direction. Thereby, while the sheet discharged onto the processing tray 42 slides down the slope of the processing tray 42, a minute reciprocation is made in the cross direction by the aligning plates 61, and this makes it possible that the sheet slides on the processing tray 42 more easily and deviation in the discharge direction is eliminated.

Moreover, the control CPU 70 calculates an estimate time from the time when it receives the sheet rear end detection signal to the time when the sheet reaches the positioning means 55 of the processing tray 42. After the estimate time has elapsed, the control CPU 70 drives the first aligning motor 65*a* and the second aligning motor 65*b* again. At this time, the control CPU 70 supplies the power supply pulses to the first aligning motor 65*a* and the second aligning motor 65*b* so that the aligning plates 61 make reciprocating movement (aligning movement) to positions corresponding to the sheet size. Thereby, the sheet discharged onto the processing tray 42 is pushed to a side of the tray and moved to the center position by the aligning plates 61.

By repeating the above-mentioned processing, sheets are stacked on the processing tray 42 and a bundle of sheets is formed. When the image formation processing on the last page of the original instructed from the user is completed by repeating the above-mentioned processing, a post-processing start signal is input from the image forming unit 2 to the control CPU 70. When the post-processing start signal is received, the control CPU 70 drives the unit moving motor 60 through the unit moving motor driving circuit 72. At this time, the control CPU 70 supplies power supply pulses to the unit moving motor 60 so that the post-processing portion 43 moves to the standby position. Thereby, the post-processing portion 43 moves from the home position to the standby position (center position in the sheet width direction).

When a sheet of the last page to be transported passes through the entrance sensor S1 formed on the conveyance path 45, a sheet rear end detection signal corresponding to the last page is input from the entrance sensor S1 to the control CPU 70. When the sheet rear end detection signal corresponding to the last page is received, the control CPU 70 calculates an estimate time from the time when it receives the sheet rear end detection signal to the time when the sheet reaches the processing tray 42, in the similar way to the above, and after the estimate time has elapsed, the control CPU 70 drives the first aligning motor 65*a* and the second aligning motor 65*b*. At this time, the control CPU 70 supplies the power supply pulses to the first aligning motor 65*a* and the second aligning motor 65*b* so that the aligning plates 61 vibrate (that is, reciprocate between two points separated by minute distance) from the above-mentioned standby positions in the cross direction of the sheet. Further, the control CPU 70 calculates an estimate time from the time when it receives the sheet rear end detection signal to the time when the sheet reaches the positioning means 55 of the processing tray 42. After the estimate time has elapsed, the control CPU 70 drives the unit moving motor 60, and simultaneously drives the first aligning motor 65*a* and the second aligning motor 65*b*. The control CPU 70 stops driving of the sheet conveyance motor depending on a lapse of the estimate time.

At this time, the control CPU 70 supplies power supply pulses to the unit moving motor 60 so that the post-processing portion 43 moves to a predetermined position on the front side, and simultaneously supplies power supply pulses to the first aligning motor 65*a* and the second aligning motor 65*b* so that a bundle of sheets on the processing tray 42 is shifted to a predetermined position on the rear side from the center position. Thereby, the post-processing portion 43 moves to the post-processing position set to perform the binding processing on the front side of the A3-size sheet, while the bundle of sheets is shifted to the post-processing undergoing position corresponding to the post-processing position. When movements of the post-processing portion 43 and the bundle of sheets are completed, a staple needle is struck out, and the binding processing is executed on the front side of the A3-size sheets.

After the binding processing on the front side of the A3-size sheets is executed, the control CPU 70 supplies power supply pulses to the unit moving motor 60 so that the post-processing portion 43 travels to a predetermined position on the rear side, and at the same time, supplies power supply pulses to the first aligning motor 65*a* and the second aligning motor 65*b* so that a bundle of sheets on the processing tray 42 is shifted from the center position to a predetermined position on the front side. Thereby, the post-processing portion 43 moves to the post-processing position set to perform the binding processing on the rear side of the A3-size sheets, while the bundle of sheets is shifted to the post-processing undergoing position corresponding to the post-processing position. When movements of the post-processing portion 43 and the bundle of sheets are completed, a staple needle is struck out, and the binding processing is executed on the rear side of the A3-size sheets.

In this way, when the binding processing on the front side and the rear side of the sheets is completed, the control CPU 70 lowers the sheet discharging mechanism 54 by a driving motor (not shown), and brings the discharging roller 51*a* into contact with the bundle of sheets. Then, the control CPU 70 drives the sheet conveyance motor through the sheet conveyance motor driving circuit 70. Thereby, the discharging roller 51*a* is rotated so as to discharge the bundle of sheets on the processing tray 42 to the collection tray 44. In this way, the finisher unit 4 completes a series of operations when performing the post-processing (binding processing).

First Embodiment

Figure 7A:
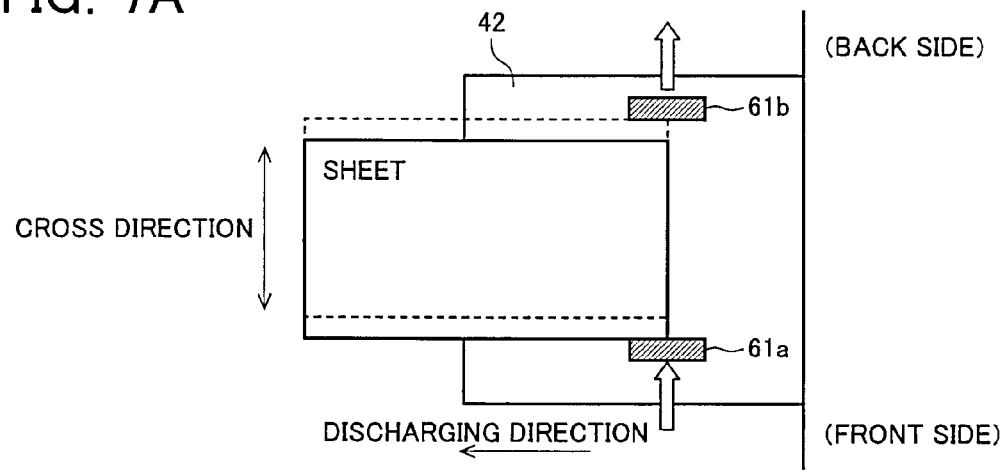
FIGS. 7A through 7C are views illustrating an example of operational states of the aligning plates according to a first embodiment of the present invention.
Figure 7B:
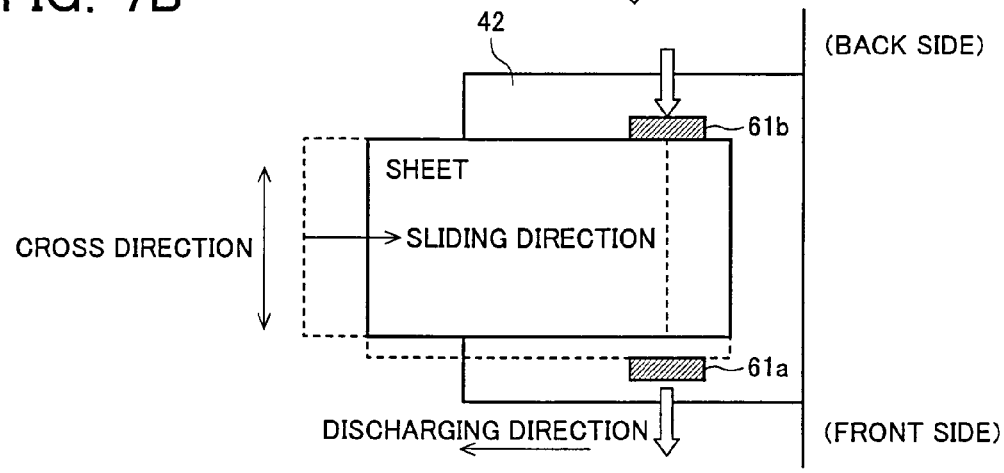
Figure 7C:
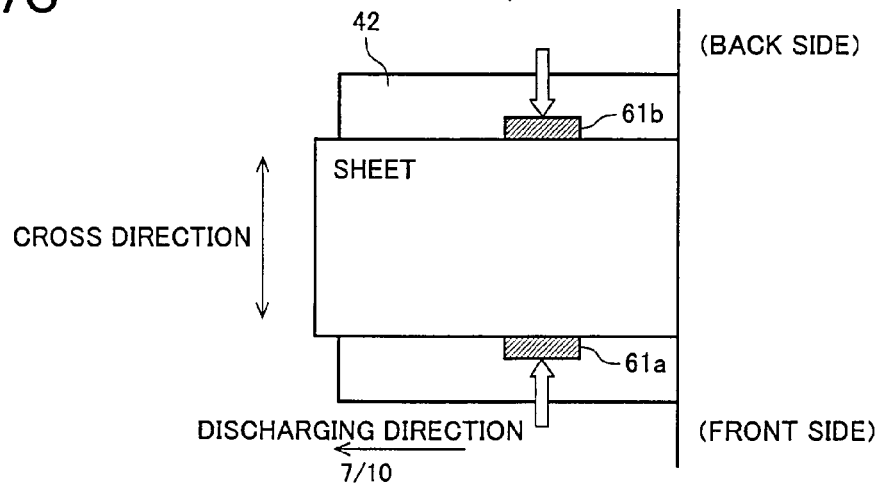
Figure 8A:
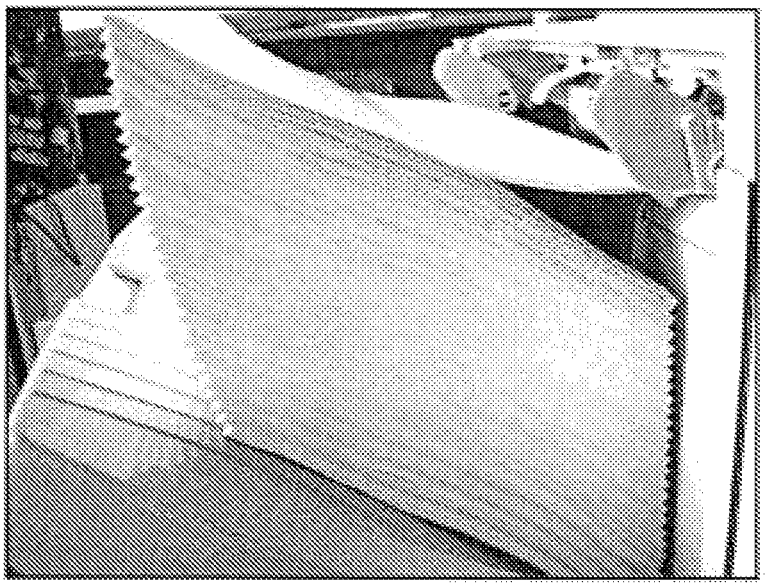
FIGS. 8A and 8B are views showing an example of a state of recording paper after post processing when the post processing is performed after aligning the recording paper in the post-processing tray.
Figure 8B:
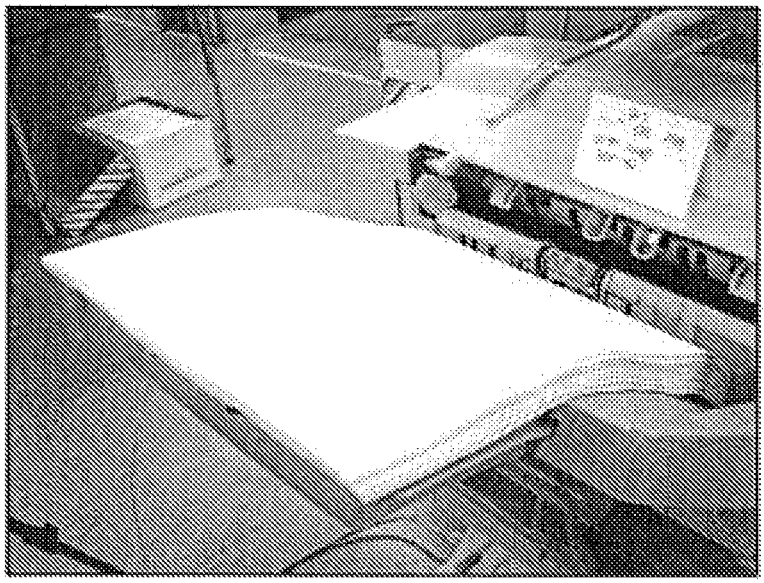

FIGS. 7A through 7C are views illustrating an example of operational states of the aligning plates 61 and show top views of the aligning plates 61 and the processing tray 42. As shown in FIG. 7A and FIG. 7B, when a sheet is discharged onto the processing tray 42 and slides down the slope of the processing tray 42 in the finisher unit 4, the aligning plates 61 make minute reciprocating movement in the cross direction of the sheet. Here, the control CPU 70 controls the pair of aligning plates 61*a* and 61*b* so as to vibrate, for example, about one to five times in the same direction. Thereby, the sheet slides down on the processing tray 42 more easily. In addition, as shown in FIG. 7C, when the sheet discharged onto the processing tray 42 is brought into contact with the lower end face of the processing tray 42, the aligning plates 61*a* and 61*b*, in accordance with the control from the control CPU 70, hold the side end of the sheet to perform aligning processing, and by aligning the cross direction of the sheet, the sheet is aligned in vertically and horizontality.

As described in FIG. 6, when the transported sheet passes through the entrance sensor S1 formed on the conveyance path 45, a sheet rear end detection signal is input from the entrance sensor S1 to the control CPU 70. When the sheet rear end detection signal is received, the control CPU 70 calculates an estimate time to pass from when the sheet is discharged to the processing tray 42 to when it reaches the processing tray 42, and after the estimate time has elapsed, the control CPU 70 drives the first aligning motor 65*a* and the second aligning motor 65*b*. At this time, the control CPU 70 supplies the power supply pulses to the first aligning motor 65*a* and the second aligning motor 65*b* so that the aligning plates 61 vibrate (that is, reciprocate between two points separated by minute distance) from the predetermined standby positions in the cross direction of the sheet. The operational step at this time will be shown below.

In FIG. 7A, when the sheet is discharged to the processing tray 42 and the sheet falls to the processing tray 42, the aligning plates 61*a* and 62*b* move to the back side in the figure.

In FIG. 7B, when the sheet falls to the processing tray 42, the aligning plates 61*a* and 61*b* move to the front side in the figure and shake the sheet, for example, one to five times.

In addition, in FIG. 7C, after the sheet slides down the slope of the processing tray 42, the sheet is sandwiched and aligned by the aligning plates 61*a* and 61*b*.

In this way, post processing (binding processing in the present embodiment) is applied by the post-processing portion 43 to the sheets aligned by the aligning plates 61*a* and 61*b*, and the sheets (bundle of sheets) after the post processing are discharged to the collecting tray 44. The state at this time will be shown in FIGS. 8A and 8B.

Second Embodiment

Figure 9A:
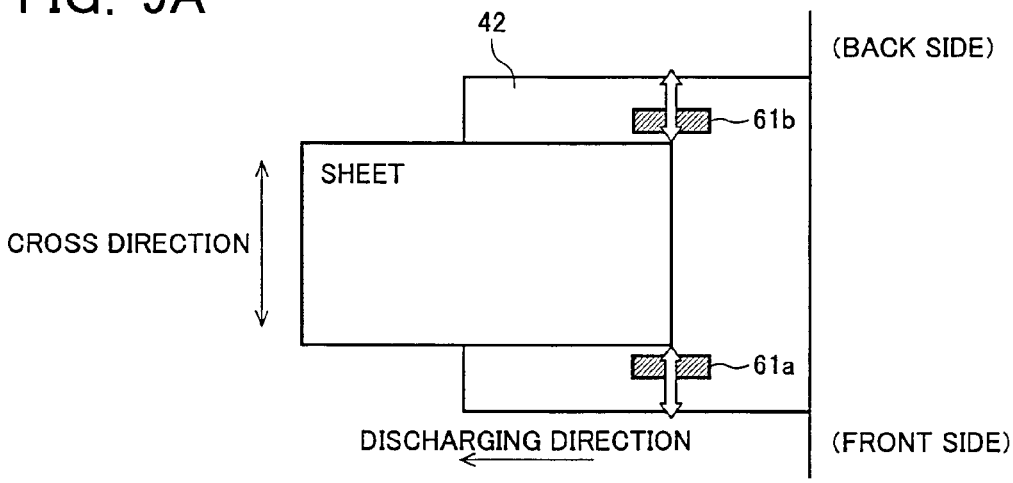
FIGS. 9A through 9C are views illustrating an example of operational states of the aligning plates according to a second embodiment of the present invention.
Figure 9B:
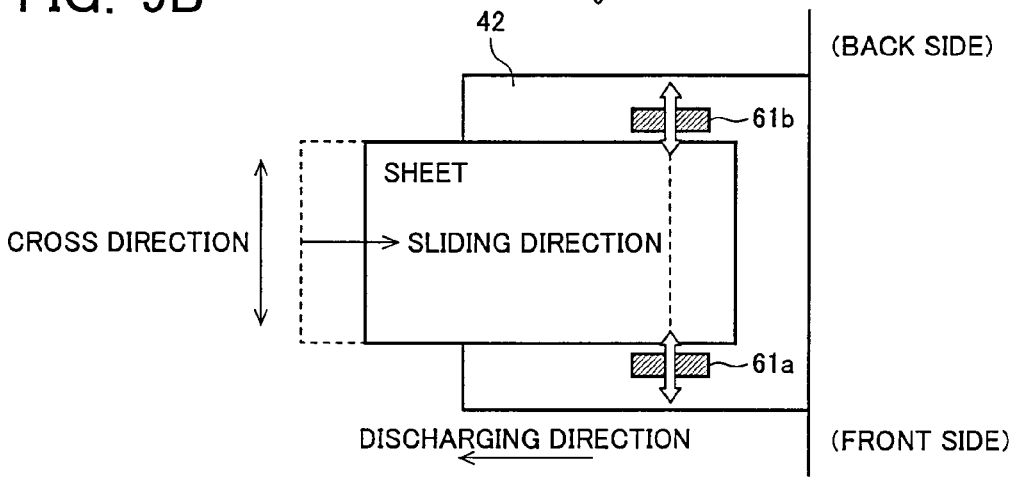
Figure 9C:
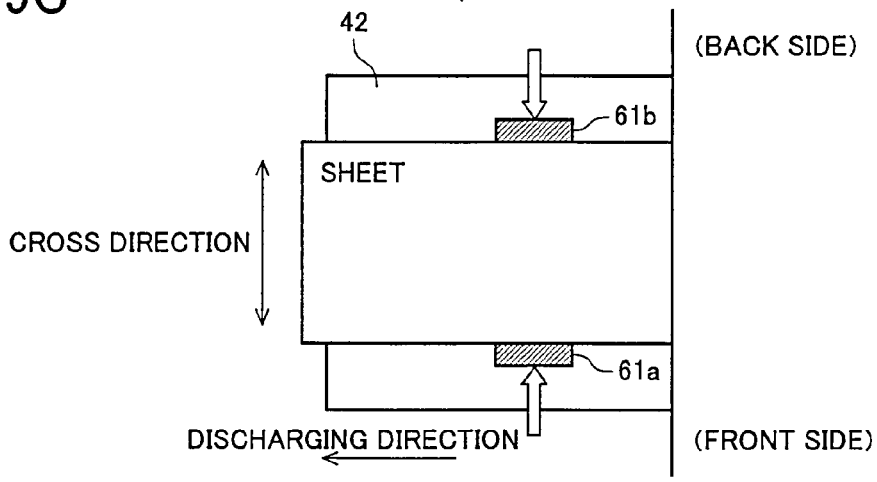
Figure 10A:
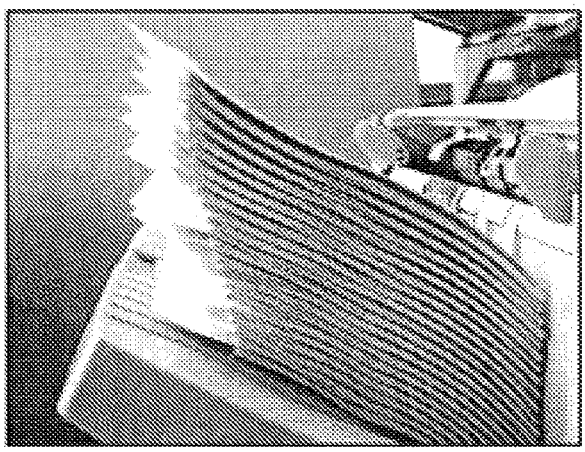
FIGS. 10A through 10C are views showing a state of recording paper after post processing when the post processing is performed in a state where the recording paper is not aligned in the post-processing tray.
Figure 10B:
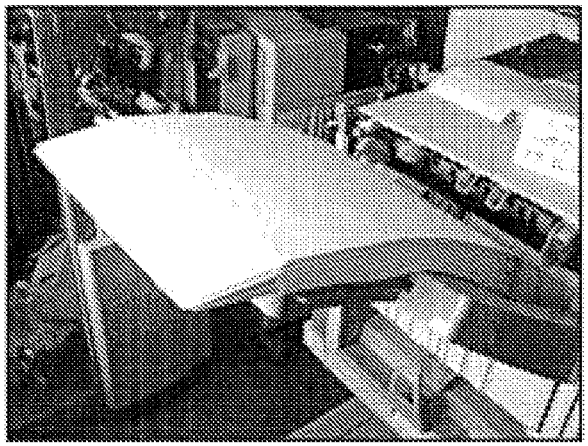
Figure 10C:
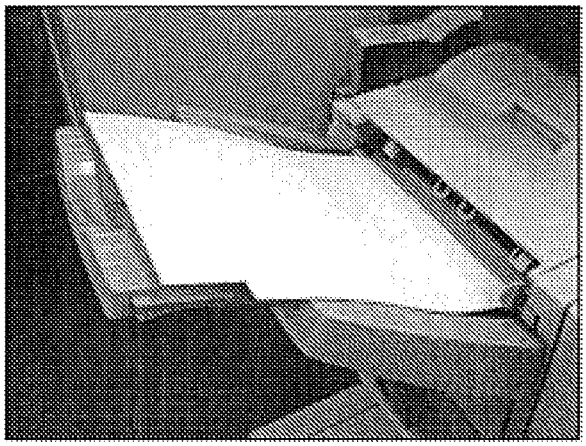

FIGS. 9A through 9C are views illustrating an example of operational states of the aligning plates 61 according to the second embodiment of the present invention and show top vies of the aligning plates 61 and the processing tray 42. As shown in FIGS. 9A to 9B, when a sheet is discharged onto the processing tray 42 and slides down the slope of the processing tray 42 in the finisher unit 4, the aligning plates 61 make minute reciprocating movement in the cross direction of the sheet. Here, the control CPU 70 controls the pair of aligning plates 61*a* and 61*b* so as to vibrate in a different direction to each other, for example, one to five times. Thereby, the sheet slides down on the processing tray 42 more easily. In addition, as shown in FIG. 9C, when the sheet discharged onto the processing tray 42 is brought into contact with the lower end face of the processing tray 42, the aligning plates 61*a* and 61*b*, in accordance with the control from the control CPU 70, sandwich the side end of the sheet to perform aligning processing, and by aligning the cross direction of the sheet, the sheet is aligned in vertically and horizontality. The operational step at this time will be shown below.

In FIG. 9A, when the sheet is discharged onto the processing tray 42 and the sheet falls to the processing tray 42, the aligning plates 61*a* and 61*b* vibrate in a different direction to each other to pat the sides of the sheet.

In FIG. 9B, when the sheet slides down on the processing tray 42, the aligning plates 61*a* and 61*b* vibrate in a different direction to each other to pat the sides of the sheet, for example, about one to five times.

In FIG. 9C, after the sheet slides down the slope of the processing tray 42, the aligning plates 61*a* and 61*b* sandwich and align the sheet.

In this way, post processing (binding processing in the present embodiment) is applied by the post-processing portion 43 to the sheet aligned by the aligning plates 61*a* and 61*b*, and the sheets (bundle of sheets) after the post processing are discharged to the collecting tray 44. The state at this time will be shown in FIGS. 8A and 8B.

Note that, as to the processing of FIG. 7B and FIG. 9B in the first and second embodiments, when the sheet is heavy paper, compared with a case where the sheet is normal paper, the number of vibration may be increased by once or twice or the number of vibration processing may be changed depending on difference in smoothness of the surface of the sheet (gloss paper and normal paper).

In this way, when discharging recording paper to the post-processing tray, by adding shaking vibration in the cross direction of the recording paper by the aligning plates, it is possible to make it easier for the recording paper to slide down the slope of the post-processing tray and to improve alignment in the discharge direction.

According to the present invention, following effects can be obtained.

Since more than one sheet of recording paper can easily slide down the slope of the processing tray using a simple structure, it is possible to eliminate irregularity in the alignment of the sheets in the discharging direction and to make the alignment of the sheets easier after that.

The invention claimed is:

1. A post-processing apparatus comprising:

a discharging portion for discharging sheets of recording paper to a post-processing tray;

recording paper guide portions for guiding both sides of the recording paper discharged by the discharging portion;

a motor for causing the recording paper guide portions to operate; and a control portion for controlling the motor, wherein when the recording paper guided by the recording paper guide portions slides down the slope of the post-processing tray, the motor, in accordance with the control of the control portion, causes the recording paper guiding portions to vibrate in the direction of the width of the recording paper.

2. The post-processing apparatus as defined in claim 1, wherein a pair of the recording paper guiding portions is included, and the motor, in accordance with the control of the control portion, causes the pair of the recording paper guiding portions to vibrate in the same direction.

3. The post-processing apparatus as defined in claim 1, wherein a pair of the recording paper guiding portions is included, and the motor, in accordance with the control of the control portion, causes the pair of the recording paper guiding portions to vibrate in a different direction to each other.

4. The post-processing apparatus as defined in claim 1, wherein when the recording paper discharged to the post-processing tray came in contact with the lower end of the post-processing tray, the motor, in accordance with the control of the control portion, causes the recording paper guide portions to operate and sandwich side ends of the recording paper to perform aligning processing.

5. The post-processing apparatus as defined in claim 4, wherein the motor, in accordance with the control of the control portion, causes the recording paper guide portions to operate and arrange the recording paper discharged to the post-processing tray in a predetermined reference position.

6. The post-processing apparatus as defined in claim 5, wherein the recording paper guiding portions are aligning plates provided in a stapling unit.

7. An image forming apparatus provided with the post-processing apparatus as defined in claim 1.

* * * * *